US009011078B2

(12) United States Patent
Winn et al.

(10) Patent No.: US 9,011,078 B2
(45) Date of Patent: Apr. 21, 2015

(54) TURBINE VANE SEAL CARRIER WITH SLOTS FOR COOLING AND ASSEMBLY

(75) Inventors: Aaron Gregory Winn, Piedmont, SC (US); Robert Walter Coign, Piedmont, SC (US)

(73) Assignee: General Electric Company, Schenectady, NY (US)

( * ) Notice: Subject to any disclaimer, the term of this patent is extended or adjusted under 35 U.S.C. 154(b) by 588 days.

(21) Appl. No.: 13/345,778

(22) Filed: Jan. 9, 2012

(65) Prior Publication Data

US 2013/0177420 A1 Jul. 11, 2013

(51) Int. Cl.

*F01D 25/00* (2006.01)
*F01D 11/00* (2006.01)
*F01D 11/02* (2006.01)

(52) U.S. Cl.

CPC ..... *F01D 11/00* (2013.01); *F01D 11/001* (2013.01); *F01D 11/003* (2013.01); *F01D 11/005* (2013.01); *F01D 11/006* (2013.01); *F01D 11/02* (2013.01)

(58) Field of Classification Search

CPC ..... F01D 11/02; F01D 11/025; F01D 11/08; F01D 11/12; F01D 11/125; F01D 11/24; F05B 2260/20; F05B 2260/201

USPC ..... 415/170.1, 173.7, 174.4, 174.5, 177, 415/178, 180, 115

See application file for complete search history.

(56) References Cited

U.S. PATENT DOCUMENTS 4,187,054 A 2/1980 Landis, Jr. et al.
4,416,457 A * 11/1983 McGinnis et al. ..... 277/414
4,679,981 A * 7/1987 Guibert et al. ..... 415/116
5,197,852 A 3/1993 Walker et al.
5,375,973 A * 12/1994 Sloop et al. ..... 415/173.1
5,609,466 A 3/1997 North et al.
5,749,701 A * 5/1998 Clarke et al. ..... 415/115
6,139,264 A * 10/2000 Schilling ..... 415/174.2
6,146,091 A * 11/2000 Watanabe et al. ..... 415/115
6,227,798 B1 5/2001 Demers et al.
6,382,906 B1 5/2002 Brassfield et al.
6,383,602 B1 5/2002 Fric et al.
6,386,825 B1 5/2002 Burdgick
6,418,618 B1 7/2002 Burdgick
6,758,653 B2 * 7/2004 Morrison ..... 415/173.4
6,761,529 B2 7/2004 Soechting et al.
6,769,865 B2 8/2004 Kress et al.
6,832,891 B2 * 12/2004 Aschenbruck et al. .... 415/173.7

(Continued)

FOREIGN PATENT DOCUMENTS

EP 1045114 A2 10/2000
EP 1555393 A2 7/2005
GB 2422641 A 8/2006

OTHER PUBLICATIONS

Search Report and Written Opinion from corresponding EP Application No. 13150156, dated Jun. 18, 2013.

*Primary Examiner* — Dwayne J White
*Assistant Examiner* — William Grigos
(74) *Attorney, Agent, or Firm* — Sutherland Asbill & Brennan LLP

(57) ABSTRACT

The present application provides a seal carrier for use about a number of flow orifices of a platform of a turbine nozzle. The seal carrier may include an inner surface facing the platform with the inner surface having a number of slots therein aligning with the flow orifices of the platform and an opposed outer surface with a seal positioned about the outer surface.

20 Claims, 3 Drawing Sheets

(56) References Cited

U.S. PATENT DOCUMENTS

| | | | | |
|---|---|---|---|---|
| 6,932,568 | B2 | 8/2005 | Powis et al. | |
| 6,984,101 | B2 | 1/2006 | Schiavo, Jr. | |
| 7,007,488 | B2 * | 3/2006 | Orlando et al. | 60/782 |
| 7,025,565 | B2 * | 4/2006 | Urso et al. | 415/173.5 |
| 7,029,228 | B2 | 4/2006 | Chan et al. | |
| 7,252,481 | B2 | 8/2007 | Stone | |
| RE40,658 | E | 3/2009 | Powis et al. | |
| 7,597,533 | B1 * | 10/2009 | Liang | 415/116 |
| 2002/0028134 | A1 | 3/2002 | Burdgick | |
| 2002/0182057 | A1 | 12/2002 | Liotta et al. | |
| 2002/0187040 | A1 | 12/2002 | Predmore | |
| 2005/0244267 | A1 | 11/2005 | Coign et al. | |
| 2006/0053798 | A1 | 3/2006 | Hadder | |
| 2006/0062673 | A1 | 3/2006 | Coign et al. | |
| 2006/0073011 | A1 | 4/2006 | Lee et al. | |
| 2007/0237624 | A1 | 10/2007 | Nigmatulin | |
| 2008/0089780 | A1 | 4/2008 | Erickson et al. | |
| 2008/0152488 | A1 | 6/2008 | Kammel et al. | |
| 2009/0123266 | A1 * | 5/2009 | Thibodeau et al. | 415/110 |
| 2010/0011773 | A1 | 1/2010 | Suleiman et al. | |
| 2010/0068041 | A1 | 3/2010 | Nigmatulin et al. | |
| 2010/0247294 | A1 * | 9/2010 | Bowes et al. | 415/170.1 |
| 2010/0278631 | A1 | 11/2010 | Heda et al. | |
| 2010/0281879 | A1 | 11/2010 | Shapiro et al. | |
| 2010/0284800 | A1 | 11/2010 | Sewall et al. | |
| 2011/0014045 | A1 | 1/2011 | McCall | |
| 2011/0014054 | A1 | 1/2011 | Nagler et al. | |
| 2011/0044803 | A1 | 2/2011 | DiPaola et al. | |

* cited by examiner

TURBINE VANE SEAL CARRIER WITH SLOTS FOR COOLING AND ASSEMBLY

TECHNICAL FIELD

The present application and the resultant patent relate generally to gas turbine engines and more particularly relate to a turbine vane seal carrier and the like with a number of slots formed on one side thereof for improved cooling and ease of assembly.

BACKGROUND OF THE INVENTION

Various types of cooling systems have been used with turbine machinery to cool different types of internal components such as casings, buckets, nozzles, and the like. Such cooling systems maintain adequate clearances between the components and promote adequate component lifetime. One such component is a turbine vane seal carrier. The seal carrier may be affixed to a platform of a cantilever turbine nozzle and the like. Such a component generally may be cooled via air supply holes in the platform or elsewhere that may be in communication with a cooling plenum or other source. Such air supply holes, however, may be difficult to produce while the overall seal carrier itself may be time consuming to assemble. Other types of cooling systems may be known.

There is thus a desire for an improved turbine vane seal carrier. The turbine vane seal carrier may provide a simplified cooling scheme in combination with a simplified assembly scheme.

SUMMARY OF THE INVENTION

The present application and the resultant patent thus provide a seal carrier for use about a number of flow orifices of a platform of a turbine nozzle. The seal carrier may include an inner surface facing the platform with the inner surface having a number of slots therein aligning with the flow orifices of the platform and an opposed outer surface with a seal positioned about the outer surface.

The present application and the resultant patent further provide a nozzle for a gas turbine. The nozzle may include a platform with an air plenum, a number of flow orifices in communication with the air plenum, and a seal carrier. The seal carrier may include a number of slots aligning with the flow orifices.

The present application and the resultant patent further provide a nozzle for a gas turbine. The nozzle may include a platform with an air plenum, a number of flow orifices in communication with the air plenum, and a seal carrier. The seal carrier may include a number of slots aligning with the flow orifices on an inner surface thereof and a seal on an outer surface thereof.

These and other features and advantages of the present application and the resultant patent will become apparent to one of ordinary skill in the art upon review of the following detailed description when taken in conjunction with the several drawings and the appended claims.

DETAILED DESCRIPTION

Figure 1:
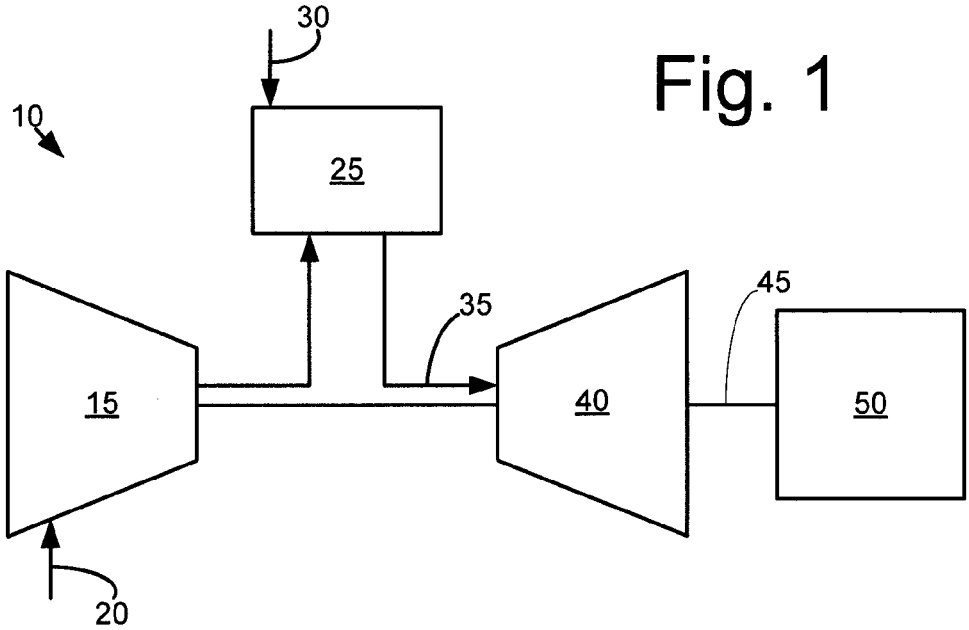
FIG. 1 is a schematic diagram of a gas turbine engine showing a compressor, a combustor, and a turbine.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, and/or other types of fuels. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
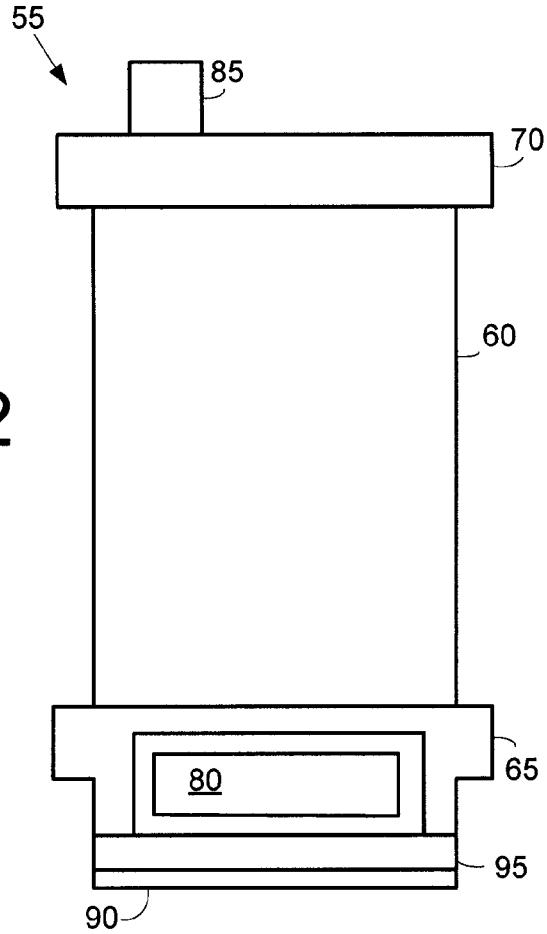
FIG. 2 is a generalized partial side view of a nozzle vane with a seal carrier.

FIG. 2 is an example of a nozzle 55 that may be used with the turbine 40 described above. Generally described, the nozzle 55 may include a nozzle vane 60 that extends between an inner platform 65 and an outer platform 70. A number of nozzles 55 may be combined into a circumferential array to form a stage with a number of rotor blades (not shown). The nozzle 55 may include an outer shroud 85. The nozzle 55 also may include a cooling plenum 80 therein. The cooling plenum 80 may be in communication with the flow of air 20 from the compressor 15 or another source via a cooling conduit. A seal 90 also may be used about the nozzle 55. The seal 90 may be positioned about a seal carrier 95. Other components and other configurations may be used herein.

Figure 3:
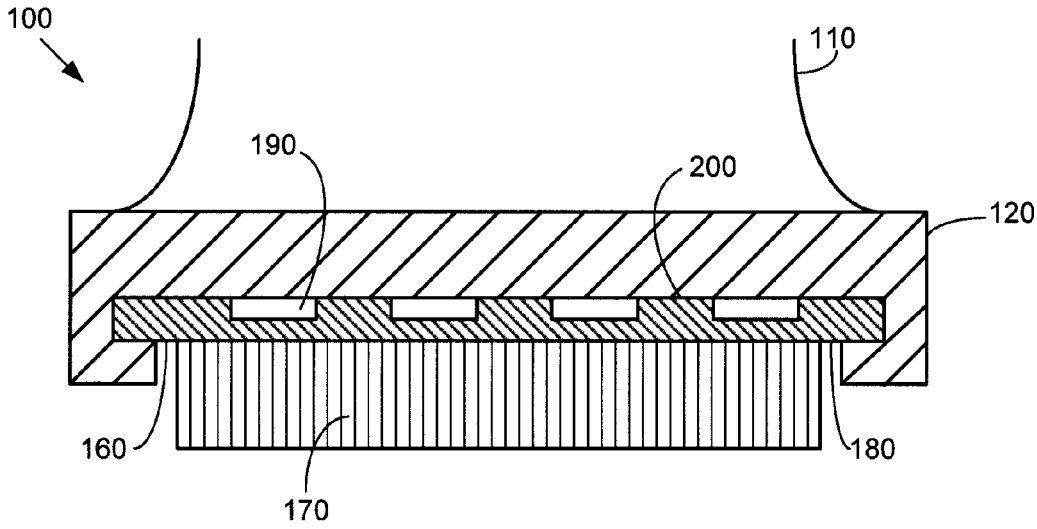
FIG. 3 is a side cross-sectional view of a nozzle with a seal carrier as may be described herein.
Figure 4:
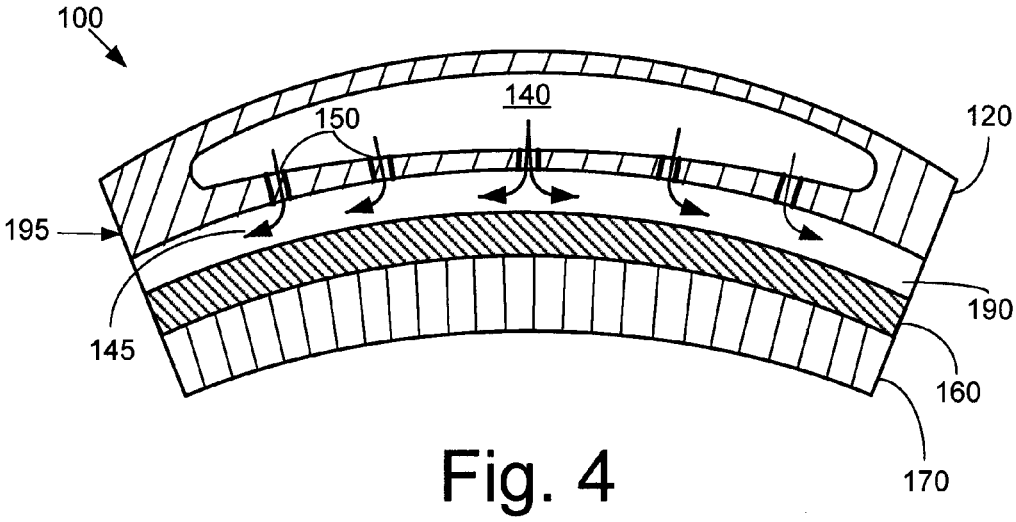
FIG. 4 is a further side cross-sectional view of the nozzle with the seal carrier of FIG. 3.

FIGS. 3 and 4 show portions of an example of a nozzle 100 as may be described herein. As above, the nozzle 100 includes a nozzle vane 110 and an inner platform 120. The inner platform 120 may include an air plenum 140 therein. The air plenum 140 may be in communication with the flow of air 20 from the compressor 15 or another source via a cooling conduit. An impingement cooling system and the like may be used herein. Other types of cooling systems also may be used. A number of flow orifices 150 may be in communication with the air plenum 140. Cooling air may flow through the flow orifices 150 as shown by directional arrows 145 and exit to ends of the slash face.

Figure 5:
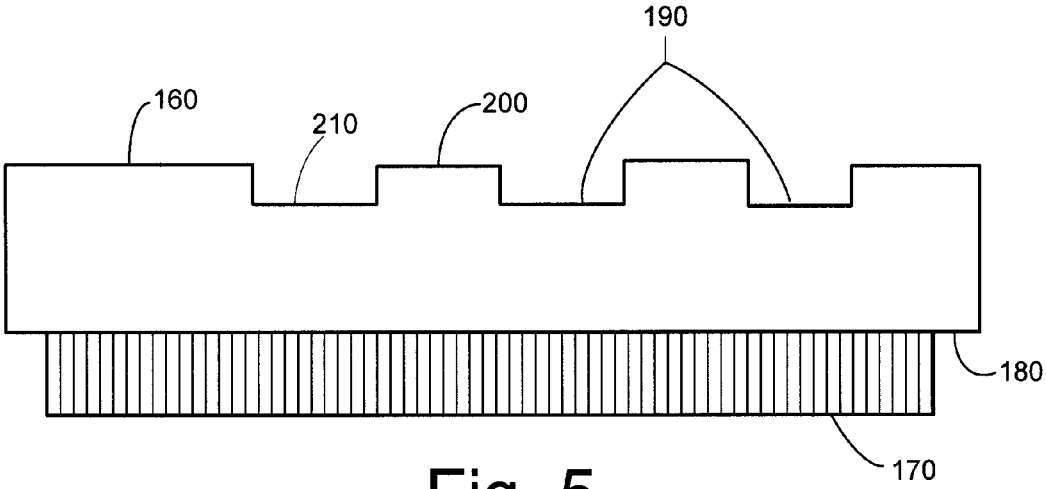
FIG. 5 is a bottom perspective view of the seal carrier of FIG. 3.
Figure 6:
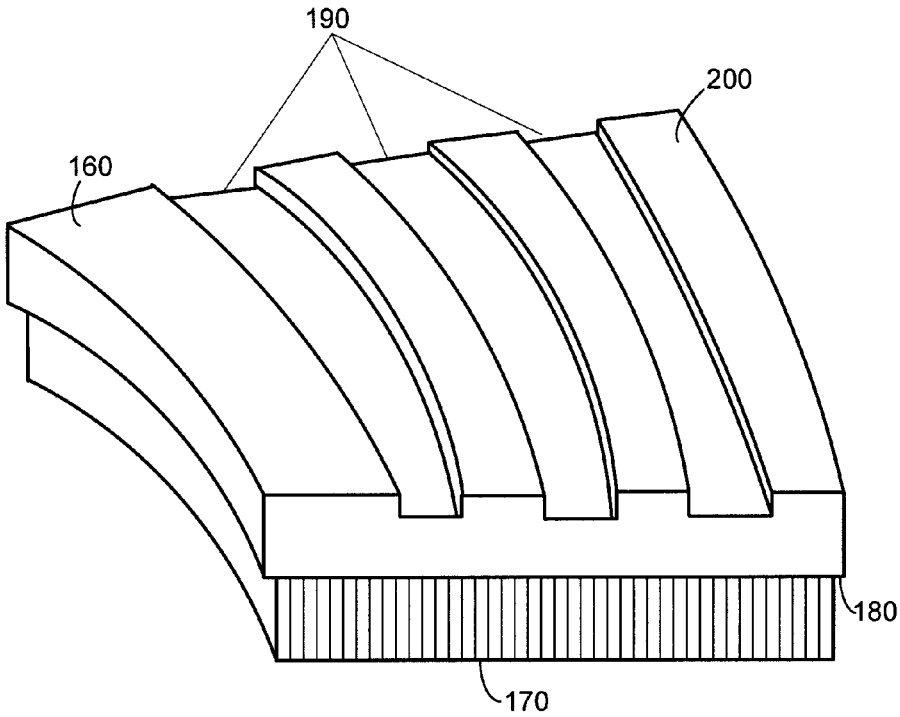
FIG. 6 is a side perspective view of the seal carrier of FIG. 3.

A seal carrier 160 as may be described herein may be mounted within the inner platform 120. A seal 170 may be mounted within the seal carrier 160 about an inner surface 180 thereof. The seal 170 may be a honeycomb seal, a lap tooth seal, an abradable seal, or other type of seal. As is shown in FIGS. 5 and 6, a number of slots 190 may be positioned on an outer surface 200 of the seal carrier 160. The slots 190 may extend across the width of the seal carrier 160 in whole or in part and may act as cooling pathways. The slots 190 may align with the flow orifices 150 so as to route the pressurized flow of air 20 to a nozzle slash face 195 (i.e., split line) or elsewhere. The slots 190 may be in the form of a number of relief cuts 210. Other types of manufacturing techniques may be used herein. The slots 190 may have any size, shape, or configuration.

In addition to providing the flow of cooling air 20, the slots 190 also help to reduce friction during overall assembly. The seal carrier 160 generally may be assembled circumferentially such that the slots 190 reduce the contact area between the nozzle 100 and the seal carrier 160. This reduced contact area reduces the overall frictional force that must be overcome during assembly. The seal carrier 160 also allows tighter radial packing so as to facilitate the positioning of wheel space seals at higher radii. Likewise, the need for slash face supply holes may be eliminated in that the same purpose is served by the slots 190. Specifically, the seal carrier 160 allows more radial space to package seal slots and cooling holes. The seal carrier 160 thus provides improved cooling with ease of assembly.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A seal carrier for use about a number of flow orifices of a platform of a turbine nozzle, comprising:

an inner surface facing the platform;

the inner surface comprising a plurality of slots therein, each slot of the plurality of slots having a first width and separated by portions of the seal carrier, wherein the portions of the seal carrier have a second width that is less than the first width, the plurality of slots aligning with the number of flow orifices of the platform, wherein each end of each of the plurality of slots exits to a slash face of the platform;

an opposed outer surface; and a seal positioned about the outer surface.

2. The seal carrier of claim 1, wherein the plurality of slots comprises a plurality of relief cuts.

3. The seal carrier of claim 1, wherein the seal comprises a honeycomb seal, a lap tooth seal, or an abradable seal.

4. The seal carrier of claim 1, further comprising a plurality of seals.

5. The seal carrier of claim 1, wherein the plurality of slots comprises a plurality of cooling pathways.

6. A nozzle for a gas turbine, comprising:

a platform;

an air plenum within the platform;

a plurality of flow orifices in communication with the air plenum; and a seal carrier;

the seal carrier comprising a plurality of slots aligning with the plurality of flow orifices, each slot of the plurality of slots having a first width and separated by portions of the seal carrier, wherein the portions of the seal carrier have a second width that is less than the first width, wherein each end of each of the plurality of slots exits to a slash face of the platform.

7. The nozzle of claim 6, wherein the plurality of slots comprises a plurality of relief cuts.

8. The nozzle of claim 6, wherein the seal carrier comprises a seal therein.

9. The nozzle of claim 8, wherein the seal comprises a honeycomb seal, a lap tooth seal, or an abradable seal.

10. The nozzle of claim 8, further comprising a plurality of seals.

11. The nozzle of claim 6, wherein the plurality of slots comprises a plurality of cooling pathways.

12. The nozzle of claim 6, wherein the air plenum is in communication with a flow of air.

13. The nozzle of claim 6, wherein the plurality of slots is positioned about an inner surface of the seal carrier.

14. The nozzle of claim 6, wherein the seal is positioned about an outer surface of the seal carrier.

15. A nozzle for a gas turbine, comprising:

a platform;

an air plenum within the platform;

a plurality of flow orifices in communication with the air plenum; and a seal carrier;

the seal carrier comprising a plurality of slots aligning with the plurality of flow orifices on an inner surface thereof and a seal on an outer surface thereof, each slot of the plurality of slots having a first width and separated by portions of the seal carrier, wherein the portions of the seal carrier have a second width that is less than the first width, the plurality of slots, wherein each end of each of the plurality of slots exits to a slash face of the platform.

16. The nozzle of claim 15, wherein the seal comprises a honeycomb seal, a lap tooth seal, or an abradable seal.

17. The nozzle of claim 15, further comprising a plurality of seals.

18. The seal carrier of claim 1, wherein the inner surface of the seal carrier is in contact with the platform.

19. The seal carrier of claim 1, wherein:

the platform comprises mounting ledges;

the seal carrier is positioned within a plenum formed by the platform; and the inner surface of the seal carrier comprises end portions having a third width greater than the first width, the end portions extending over the seal and configured to be received and secured within the plenum by the mounting ledges.

20. The seal carrier of claim 1, wherein the seal has a fourth width that is equal to the sum of a first total width of the plurality of slots and a second total width of the portions of the inner surface separating the plurality of slots.

* * * * *